United States Patent [19]

Rowe

[11] 4,103,579

[45] Aug. 1, 1978

[54] DEVICE FOR SLICING A BLOCK OF CHEESE AND THE LIKE

[75] Inventor: Blaine F. Rowe, Edina, Minn.

[73] Assignee: Plastics, Inc., St. Paul, Minn.

[21] Appl. No.: 807,246

[22] Filed: Jun. 16, 1977

[51] Int. Cl.[2] ..... B26D 7/06; B26D 4/12

[52] U.S. Cl. ..... 83/435.1; 83/437; 83/651.1

[58] Field of Search ..... 83/437, 651.1, 762, 83/466.1, 648, 401, 435.1

[56] References Cited

U.S. PATENT DOCUMENTS

| | | | |
|---|---|---|---|
| 1,515,014 | 11/1924 | Downs | 83/762 |
| 1,796,212 | 3/1931 | Nadeo | 83/651.1 X |
| 2,924,256 | 2/1960 | Reiland | 83/435.1 X |

*Primary Examiner*—Willie G. Abercrombie
*Attorney, Agent, or Firm*—Wicks & Nemer

[57] ABSTRACT

A device for slicing a block of cheese and the like including a base having spaced side members with a flange on the inner surface of each side member. A pallet for mounting a block of cheese thereon is slideably mounted on the flanges of the side members. An upright member is mounted on each side member, each upright formed with a channel formation. A cutter member is slideably mounted in the channel formations of the uprights, and the cutter member includes a frame formed of a top bar with a pair of spaced legs extending therefrom. A cutter wire is secured at one end to one leg under compression whereby at the other end to the other leg, and the cutter wire has an arcuate formation extending away from the ends of the legs and convexly toward the pallet which causes a complete cut through a block of cheese when the cutter member wire is forced through a block of cheese to and upon the pallet.

5 Claims, 9 Drawing Figures

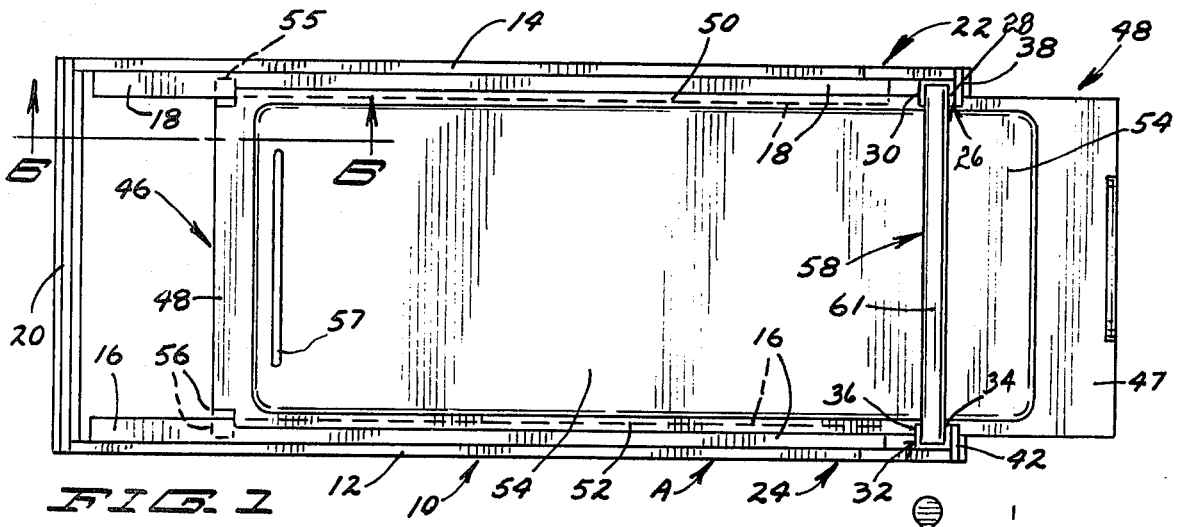
FIG. 1
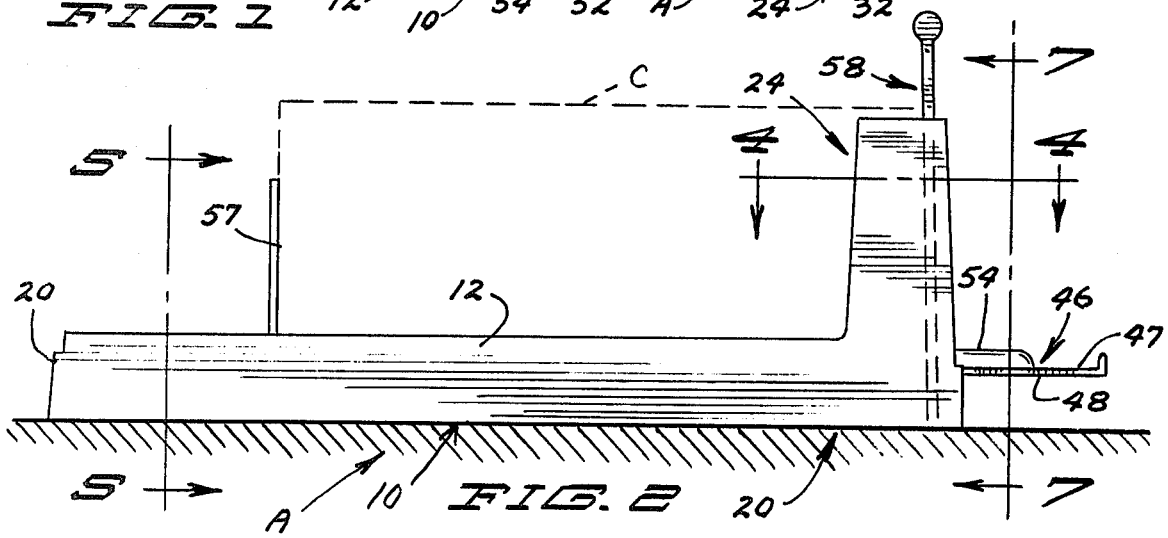
FIG. 2
FIG. 3
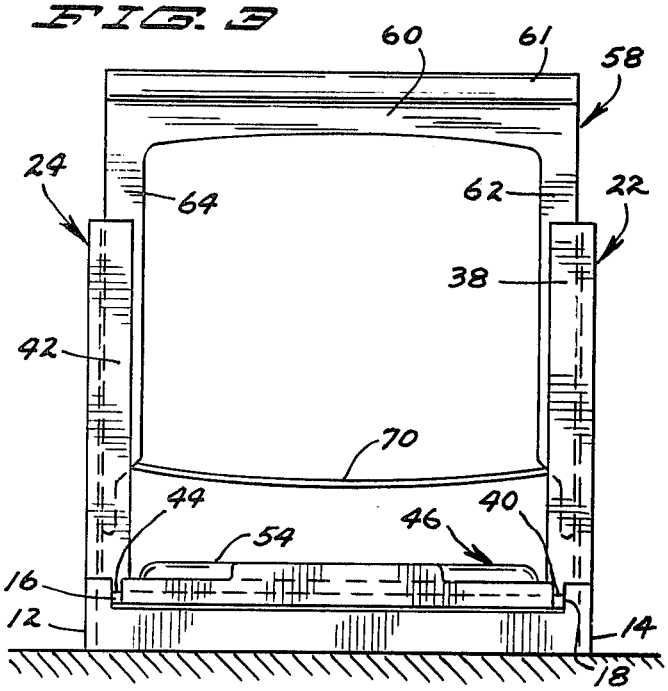
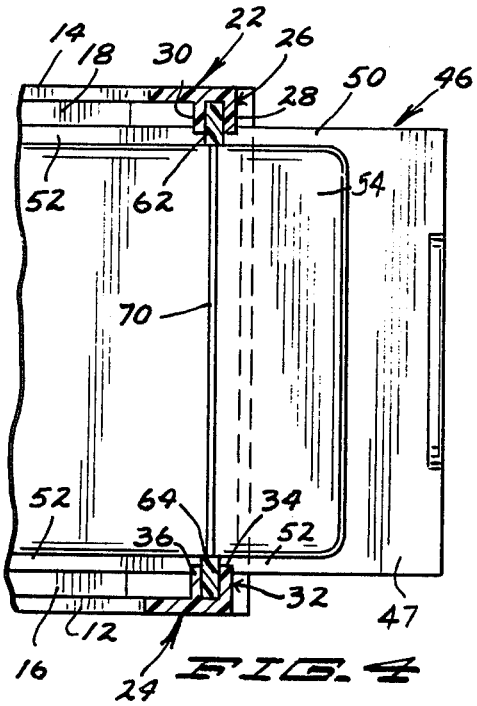
FIG. 4

FIG. 5
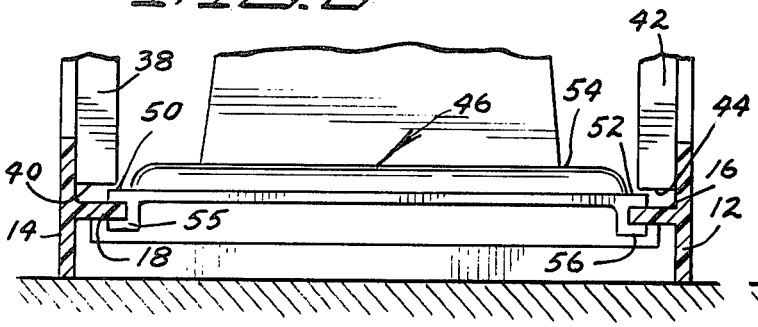
FIG. 6
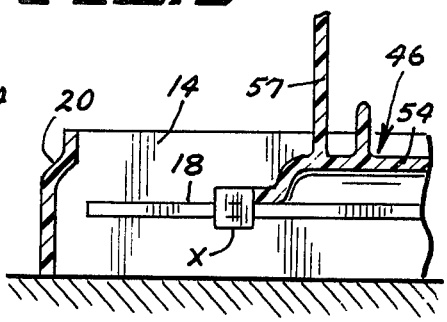
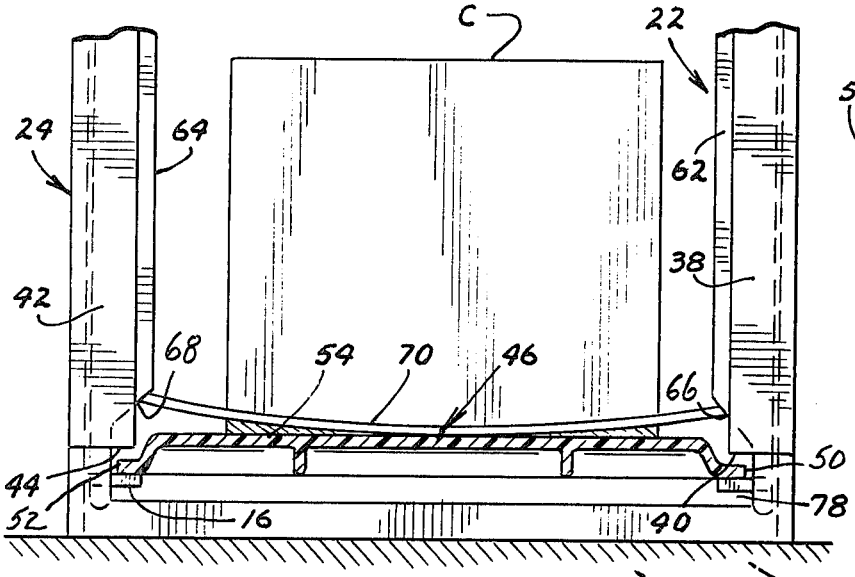
FIG. 7
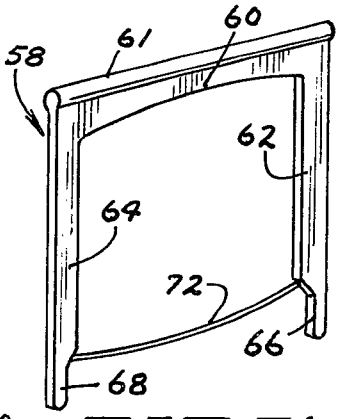
FIG. 7A
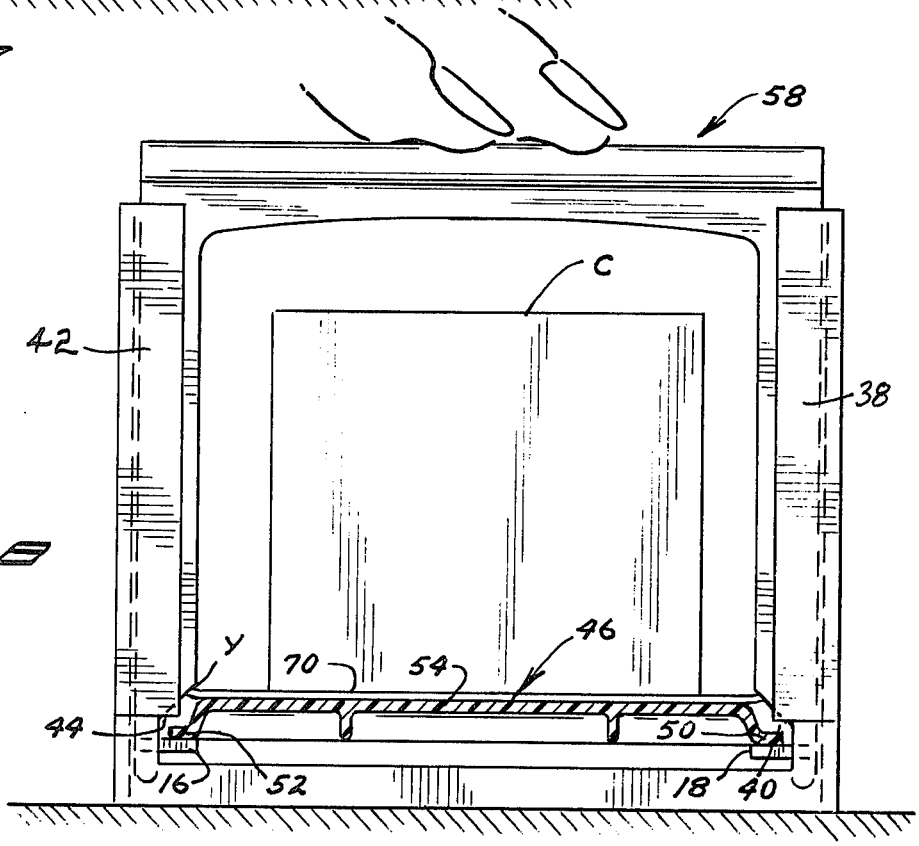
FIG. 8

DEVICE FOR SLICING A BLOCK OF CHEESE AND THE LIKE

SUMMARY

The invention relates to a device for slicing a block of cheese or the like into slices of any desirable thickness. It is an object of the invention to provide a device for cutting a block of cheese and the like into slices which includes a base having a pallet slideably mounted on flanges internally of the base for extension of the pallet from the base as cheese is sliced from the block. The cheese block is sliced by means of a cutter member slideably mounted in a pair of spaced channel members positioned normal to the pallet. The cutter member includes a frame having a top bar from which depends a pair of spaced legs and connected to and extending between the lower free ends of the legs under compression is a wire which is arcuately formed throughout its length and positioned convexly toward the pallet.

Cutter members employing straight wire cutters cut through the cheese, but the cut through the block is not complete at the ends of the wire cutter even at the bottom of the cut due to drag through the cheese which causes an upward arcuing of the wire away from the pallet. With the wire cutter arcuately formed convexly toward the pallet a cut through a block of cheese is complete when the wire is caused to touch the pallet its entire length of the wire across the pallet by forcing the cutter downwardly.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 1 is a top plan view of device for slicing a block of cleese or the like with the pallet board in a slightly extended condition and embodying the invention.

FIG. 2 is a side elevational view thereof.

FIG. 3 is a front end view thereof.

FIG. 4 is a partial sectional view on the line 4 — 4 of FIG. 2.

FIG. 5 is a sectional view on the line 5 — 5 of FIG. 2.

FIG. 6 is partial sectional view on the line 6 — 6 of FIG. 1.

FIG. 7 is a view on the line 7 — 7 of FIG. 2 with the cutter member approaching a fully lowered cutting position a portion of the pallet board being in section.

FIG. 7*a* is a reduced perspective view of the cutter member removed from the device.

FIG. 8 is a view similar to FIG. 7 but with the cutter member in a fully lowered position upon the pallet board.

Referring to the drawings in detail, the device for slicing a block of cheese A includes the base 10 which includes the elongated side members 12 and 14. Extending inwardly from the inner faces of the side members 12 and 14 are the flanges 16 and 18. The rear ends of the side members 12 and 14 are connected by the transverse rear end piece 20. Secured to and extending upwardly from the side member 12 is a first upright 22, and secured to and extending upwardly from the side member 14 is a second upright 24.

The first upright 22 has formed on the inner surface thereof the channel 26 including the spaced side portions 28 and 30 secured to the upright 22. Similarly the second upright 24 has formed on the inner surface thereof the channel 32 including the spaced side portions 34 and 36 secured to the upright 24. The numeral 38 designates a first end support to the side member 14 and upon the channel 30 with the end of the end support designated as 40. The numeral 42 designates a second end support secured to the side member 12 and upon the channel 32 with the end of the end support designated as 44.

The numeral 46 designates a pallet having the base portion 48 which forms side flanges 50 and 52 and extending between the flanges 50 and 52 is the raised and flat portion 54. The side flanges 50 and 52 extend throughout the length of the pallet and slideably ride upon the flanges 18 and 16, respectively, and under the ends 40 and 44 of the end supports 38 and 42, respectively, to prevent displacement of the pallet at the uprights 22 and 24.

At the inner end of the pallet 46 and adjacent the end of the flange 50 is a first lug 54 spaced from the flange 50. The flange 50 and the lug 55 engage the flange 18 therebetween for slideable movement of the pallet upon one side on the flange 18 and against displacement. Similarly, at the inner end of the pallet 46 and adjacent the end of the flange 52 is a second lug 56 spaced from the flange 52. The flange 52 and the lug 56 engage the flange 16 therebetween for slideable movement of the pallet upon one side on the flange 16 and against displacement.

Secured to the top surface of the raised flat portion 54 of the pallet is the upright wall portion 57 used to act as a pusher member for the pallet. The pallet may be slideably pulled by the end portion 47 of the pallet.

Further provided is the guillotine cutter member 58 which includes the top cross bar 60 with the rod formation 61 connected to the top edge of the bar and extending from one end of the bar is a first right angular leg 62. Extending from the other end of the bar 60 is a second right angular leg 64. The leg 62 is recessed as at 66 at the lower end thereof, and the leg 64 is also recessed as at 68 at the lower end thereof. Additionally provided is the cutter wire 70 flexible by reason of its very nature which is secured at one end to the leg 62 and at the other end to the leg 64 at the recesses 66 and 68 under compression. The cutter wire has a slight arc formation due to the mounting under compression with the outside of the arc extending downwardly and away from the ends of the legs 62 and 64. The recesses 66 and 68 allow the legs 62 and 64 to bypass the pallet.

The legs 62 and 64 of the cutter 58 slideably fit in the channels 26 and 32 which places the wire 70 directly above the pallet for cutting a block of cheese C or the like on the pallet.

The use and desirability of the device A is as follows:

A block of cheese C, for example, is placed on the pallet 46 as illustrated in FIG. 2 in broken lines with the pallet substantially within the base 10. The cutter member 58 is then raised to full upper position whereby the cutter wire 70 is above the plane of the top of the cheese. Then the pallet is pulled outwardly with the cheese C thereon a distance equal to the thickness of a desired slice of cheese. This places the cheese block C under the cutter member. Then the cutter 58 is moved downwardly by the user thereby forcing the cutter wire through the cheese. The cutter wire 70 proceeds to the point shown in FIG. 7*a* where almost all of the cut has been made except at the outermost edges of the block.

Then the downward pressure on the cutter memeber is continued whereby the cutter wire cuts the block of cheese entirely across and through the block transversely due to the arcuate formation of the wire which does not arc in the center away from the pallet.

Having thus described the invention, what is claimed as new and desired to be secured by Letters Patent is:

1. A device for slicing a block of cheese and the like comprising:
   (a) a base having
   (b) spaced flanges carried thereby,
   (c) a pallet for mounting a block of cheese or the like thereon,
   (d) means slideably mounting said pallet on said flanges,
   (e) a cutter,
   (f) means slideably mounting said cutter on said base normal thereto,
   (g) said cutter having a frame including first and second spaced legs,
   (h) a wire member secured at one end to said first leg and at the other end to said second leg under compression so as to be positioned convexly toward said pallet and contactable with said pallet with the pallet tangentially thereof so that the entire length of the wire member is pressed through a block of cheese to a position upon and extending completely across the pallet.

2. The device of claim 1 in which
   (a) said base has spaced side walls on which said flanges are carried.

3. The device of claim 2 in which said means slideably mounting said pallet on said base includes
   (a) flange means on each side of said pallet slideable upon and in engagement with said flanges of said sidewalls of said base.

4. The device of claim 3 in which
   (a) said means slideably mounting said cutter on said base includes
   (b) first and second channel members mounted in spaced relation on said base and within which said cutter is mounted.

5. In a device for slicing a block of cheese and the like having a base, a pallet slideable relative to the base, a cutter member moveable upon the base relative to the pallet adapted to cut cheese and the like mounted on the pallet, the improvement in said cutter, said cutter comprising
   (a) a frame having a top portion with first and second spaced legs depending therefrom,
   (b) a wire member connected at one end to said first leg and at the other end to said other leg under compression sufficient to form a convex formation toward the pallet and contactable with the pallet the entire length of the wire member when the member is pressed through a block of cheese to a position upon and extending completely across the pallet.

* * * * *